US009097141B2

(12) United States Patent
Paradis

(10) Patent No.: US 9,097,141 B2
(45) Date of Patent: Aug. 4, 2015

(54) AXIAL BOLTING ARRANGEMENT FOR MID TURBINE FRAME

(75) Inventor: Vincent Paradis, Montreal (CA)

(73) Assignee: PRATT & WHITNEY CANADA CORP., Longueuil, Quebec (CA)

( * ) Notice: Subject to any disclaimer, the term of this patent is extended or adjusted under 35 U.S.C. 154(b) by 929 days.

(21) Appl. No.: 13/233,584

(22) Filed: Sep. 15, 2011

(65) Prior Publication Data

US 2013/0067930 A1 Mar. 21, 2013

(51) Int. Cl.
*F01D 25/24* (2006.01)

(52) U.S. Cl.
CPC ..... *F01D 25/243* (2013.01)

(58) Field of Classification Search
CPC ..... F01D 25/243; F01D 25/28; F01D 25/162; F05D 2240/14; F05D 2240/90; F05D 2240/91; F05D 2240/54; F05D 2260/30
USPC ..... 60/796, 798; 415/142, 213.1; 384/252
See application file for complete search history.

(56) References Cited

U.S. PATENT DOCUMENTS

| | | | | |
|---|---|---|---|---|
| 2,869,941 | A * | 1/1959 | Shoup, Jr. et al. | 415/142 |
| 3,620,641 | A | 11/1971 | Keen et al. | |
| 4,979,872 | A * | 12/1990 | Myers et al. | 415/142 |
| 5,272,869 | A | 12/1993 | Dawson et al. | |
| 5,292,227 | A | 3/1994 | Czachor et al. | |
| 5,438,756 | A | 8/1995 | Halchak et al. | |
| 6,358,001 | B1 | 3/2002 | Bosel et al. | |
| 6,439,841 | B1 | 8/2002 | Bosel | |
| 6,860,716 | B2 | 3/2005 | Czachor et al. | |
| 7,195,447 | B2 | 3/2007 | Moniz et al. | |
| 7,303,377 | B2 | 12/2007 | Rockarts et al. | |
| 8,721,256 | B2 * | 5/2014 | Servant | 415/142 |
| 2009/0180864 | A1 | 7/2009 | Alvanos et al. | |
| 2010/0021286 | A1 | 1/2010 | Somanath et al. | |
| 2012/0186270 | A1 * | 7/2012 | Tatman et al. | 60/796 |

* cited by examiner

*Primary Examiner* — J. Gregory Pickett
(74) *Attorney, Agent, or Firm* — Norton Rose Fulbright Canada LLP

(57) ABSTRACT

A mid turbine frame of a gas turbine engine has a plurality of circumferentially spaced load transfer spokes extending radially between outer and inner cases. The load transfer spokes have a circumferentially enlarged inner end which is mounted to the inner case by a plurality of axially disposed fasteners extending through the inner case and spokes.

16 Claims, 4 Drawing Sheets

AXIAL BOLTING ARRANGEMENT FOR MID TURBINE FRAME

TECHNICAL FIELD

The described subject matter relates generally to gas turbine engines and more particularly, to engine case structures of gas turbine engines, such as mid turbine frames and similar structures.

BACKGROUND OF THE ART

A mid turbine frame (MTF), sometimes referred to as an "interturbine frame", is located generally between a high pressure turbine stage and a low pressure turbine stage of a gas turbine engine, to support one or more bearings and to transfer bearing loads to an outer engine case through an array of load transfer spokes. This structure allows an inter-turbine vane (ITV) assembly which is disposed between inner and outer cases of the mid turbine frame, to be non-structural and therefore of simplified ITV design, resulting in better duct/airfoil efficiency. Among various challenges facing the designer of a mid turbine frame, is the connection between the load transfer spokes and the inner case within the available radial space between the ITV and the inner case.

Accordingly, there is a need to provide an improved mid turbine frame for gas turbine engines.

SUMMARY

In one aspect, the described subject matter provides a gas turbine engine mid turbine frame comprising an annular outer case and an annular inner case, the inner and outer cases positioned around an engine axis, a plurality of circumferentially spaced load transfer spokes extending radially between the inner and outer cases, the inner case supporting at least one main shaft bearing assembly of the engine, the inner case co-axially mounted to the outer case by the spokes; and the spokes having an inner end having a width which is circumferentially enlarged relative to a width of a remainder of the spoke, the inner end having a radially and circumferentially extending face configured to mate a corresponding face on the inner case, a plurality of threaded fasteners extending axially through said mating faces to mount the respective spoke to the inner case.

In another aspect, the described subject matter provides a gas turbine engine having a mid turbine frame assembly, the mid turbine frame assembly comprising an annular outer case configured to be connected to and provide a portion of an engine casing; an annular inner case co-axially disposed within the outer case, the inner case supporting at least one bearing of an engine main shaft; at least three circumferentially spaced load transfer spokes extending radially between the inner and outer cases, each of the spokes being connected to the outer case by at least one bolt; and wherein an inner end of each of the spokes is integrated with a curved plate, the curved plate extending circumferentially to mate with a circumferential section of an annular and radial flange of the inner case, and a plurality of axially disposed bolts fastening the curved plate to the annular and radial flange.

In a further aspect, the described subject matter provides a gas turbine engine having a mid turbine frame assembly, the mid turbine frame assembly comprising an annular outer case configured to be connected to and provide a portion of an engine casing; an annular inner case co-axially disposed within the outer case, the inner case supporting at least one bearing of an engine main shaft; at least three circumferentially spaced load transfer spokes extending radially between the inner and outer cases, each of the spokes being connected to the outer case by at least one bolt; an inter-turbine vane assembly disposed co-axially and radially between the inner and outer cases, the assembly including an annular duct to direct a combustion gas flow to pass therethrough, the duct being defined between annular outer and inner duct walls radially spaced apart and interconnected by at least three radial hollow vanes, the vanes cooperating with openings in the walls to provide radial passageways through the annular duct for receiving the respective spokes to radially extend through the duct; and wherein an inner end of each of the spokes is integrated with a curved plate, the curved plate extending from the inner end oppositely in a circumferential direction to mate with a circumferential section of an annular and radial flange of the inner case, a plurality of axially disposed bolts fastening the curved plate to the annular and radial flange.

Further details of these and other aspects of the described subject matter will be apparent from the detailed description and drawings included below.

BRIEF DESCRIPTION OF THE DRAWINGS

Reference is now made to the accompanying drawings depicting aspects of the described subject matter, in which.

It will be noted that throughout the appended drawings, like features are identified by like reference numerals.

DETAILED DESCRIPTION

Figure 1:
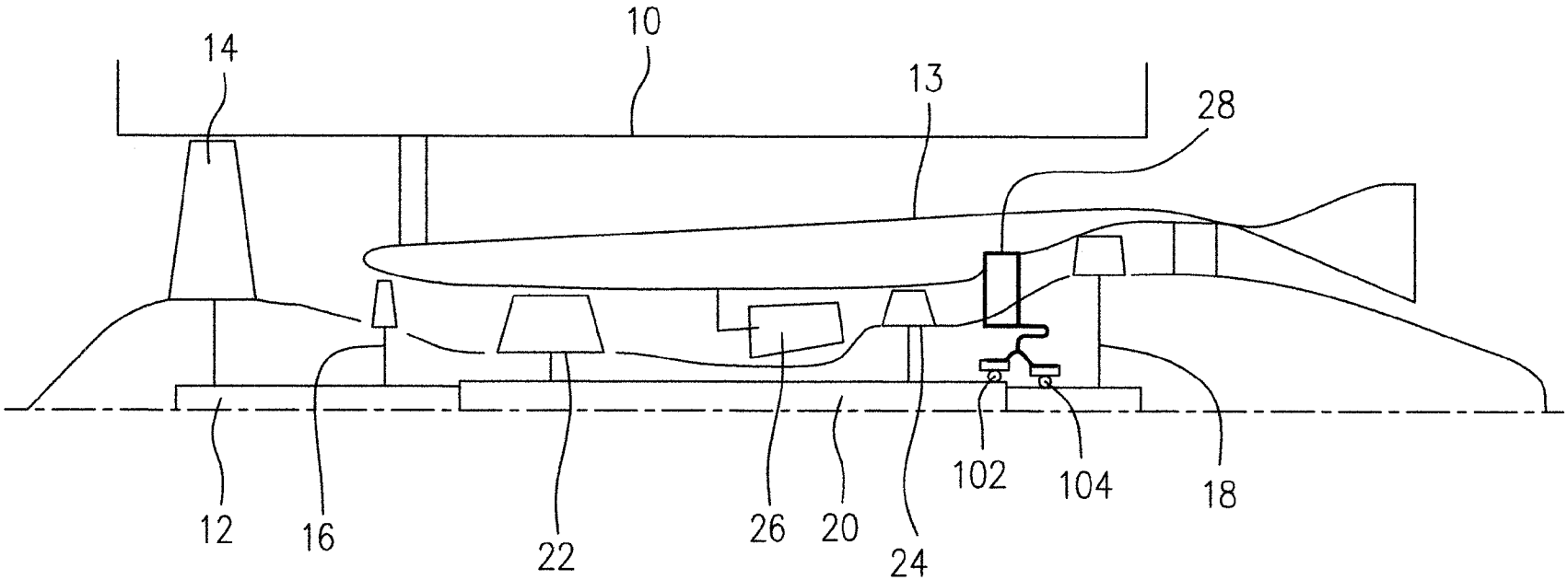
FIG. 1 is a schematic cross-sectional view of a turbofan gas turbine engine as an exemplary application of the described subject matter.

Referring to FIG. 1, a turbofan gas turbine engine includes a fan case 10, a core case 13, a low pressure spool assembly (not numbered) which includes a fan assembly 14, a low pressure compressor assembly 16 and a low pressure turbine assembly 18 connected by a shaft 12, and a high pressure spool assembly (not numbered) which includes a high pressure compressor assembly 22 and a high pressure turbine assembly 24 connected by a turbine shaft 20. The core casing 13 surrounds the low and high pressure spool assemblies to define a main fluid path (not numbered) therethrough. In the main fluid path there is provided a combustor 26 to generate combustion gases for powering the high pressure turbine assembly 24 and the low pressure turbine assembly 18. A mid turbine frame 28 is disposed axially between the high pressure turbine assembly 24 and the low pressure turbine assembly 18 and supports bearings 102 and 104 around the respective shafts 20 and 12.

The terms "axial", radial" and "circumferential" used for various components discussed below, are defined with respect to the main engine axis shown but not numbered in FIG. 1, except where otherwise specified.

Referring to FIGS. 1-5, the mid turbine frame (MTF) 28 includes an annular outer case 30 which has mounting flanges (not numbered) at both ends for connection to other components (not numbered) which cooperate to provide the core casing 13 of the engine. The outer case 30 may thus be part of the engine casing. An annular inner case 32 is coaxially disposed within the outer case 30 and a plurality of load transfer spokes 34 (at least 3 spokes) radially extend between the outer case 30 and the inner case 32. The inner case 32 according to one embodiment, may generally include an annular axial wall 36 with a U-shaped cross-section and an annular and radial mounting flange 38 radially and outwardly extending from the annular axial wall 36 for connection to the respective load transfer spokes 34. The inner case 32 supports, for example, bearing housing assemblies 40, 42 (schematically shown in FIG. 2) mounted thereto in a suitable fashion, which accommodate one or more main shaft bearing assemblies, such as bearings 102 and 104, as shown in FIG. 1.

The MTF 28 is provided with an interturbine vane (ITV) assembly 44 for directing combustion gases to flow through the MTF 28. The ITV assembly 44 according to one embodiment, may include an annular duct 46 radially defined between an annular outer duct wall 48 and an annular inner duct wall 50.

The ITV assembly 44 further includes a plurality of radially-extending hollow struts or vanes 52 (at least three struts) which are integrally affixed, for example by welding, to the respective outer and inner duct walls 48 and 50. A plurality of openings 54, 56 are defined in the respective outer and inner duct walls 48, 50 and are aligned with the respective hollow struts or vanes 52 to receive the respective load transfer spokes 34 radially extending through the hollow struts or vanes 52.

The hollow struts or vanes 52 which structurally link the outer and inner duct walls 48, 50, may have a fairing profile to reduce pressure loss when the combustion gas flow passes by. Alternatively, the hollow struts or vanes 52 may have an airfoil shape to provide aerodynamic functions.

The ITV assembly 44 may have retaining apparatus 58 for engagement with corresponding retaining apparatus 60 provided on the outer case 30, for supporting the ITV assembly 44 within the outer case 30 in a manner such that the ITV assembly 44 is subjected to thermal loads but not substantially affected by the radial loads which are borne by the respective load transfer spokes 34. Seals may also be provided to the ITV assembly 44 when installed in the MTF 28 to avoid hot gas ingestion, controlled distribution of cooling air, etc.

Outer ends 62 of the respective load transfer spokes 34 may be connected to the annular outer case 30 in any suitable manner. In one embodiment, the outer end 62 of the load transfer spoke 34 has a cylindrical outer end section (not numbered) received in an opening 64 defined in a boss 66 integrated with the outer case 30. A radial fastener 68 secures the outer end 62 of the load transfer spoke 34 to the outer case 30.

The load transfer spoke 34 in one embodiment, may include an enlarged inner end 74 integrated with a curved plate 76 extending circumferentially and oppositely from the spoke 34. The inner end 74 itself, is also integrated with the load transfer spokes 34. The load transfer spoke 34 with such an enlarged inner end 74 including the circumferentially curved plate 76, may present a profile in a substantial T-shape. The circumferentially curved plate 76 includes two opposite radial surfaces (not numbered) and a plurality of holes 78 (four holes shown in the drawings) extending between the opposed radial surfaces of the curved plate 76. The circumferentially curved plate 76 is mounted, for example to the annular and radial flange 38 of the inner case 32 by a plurality of axially exposed bolts 80 which extend axially through holes (not shown) in the annular and radial flange 38 and the holes 78 in the circumferentially curved plate 76 of the respective load transfer spokes 34.

For a greater certainty, it should be noted that the words "integral" and "integrated" used throughout this application are intended to describe a feature of components as non-disassemblable without destruction.

The circumferentially curved plate 76 of the load transfer spoke 34 according to one embodiment, may be provided with a plurality of clinch nuts 81 attached to one of the opposed radial surfaces at the front side of the plate 76 and may be received in the respective mounting holes 78 for convenience of fastening the axially disposed bolts 80 during installation of the MTF 28. The circumferentially curved plate 76 may include a ridge 82 projecting axially from a periphery of the radial surface at the front side of the circumferentially curved plate 76 for engagement with a flat surface of the respective clinch nuts 81, thereby preventing the clinch nuts 81 from rotating when the bolts 80 are fastened into the respective clinch nuts 81. An axial reinforcing rib 84 may be provided in a middle location at the front side of the circumferentially curved plate 76. A lug 86 according to one embodiment may be provided, for example at the rear side of the circumferentially curved plate 76, integrally and axially extending from the circumferentially curved plate 76 to radially abut an outer periphery of the inner case 32, such as an outer edge (not numbered) of the annular and radial mounting flange 38 of the inner case 32. The lug 86 bears a portion of radial loads in the event of blade-off.

Figure 5:
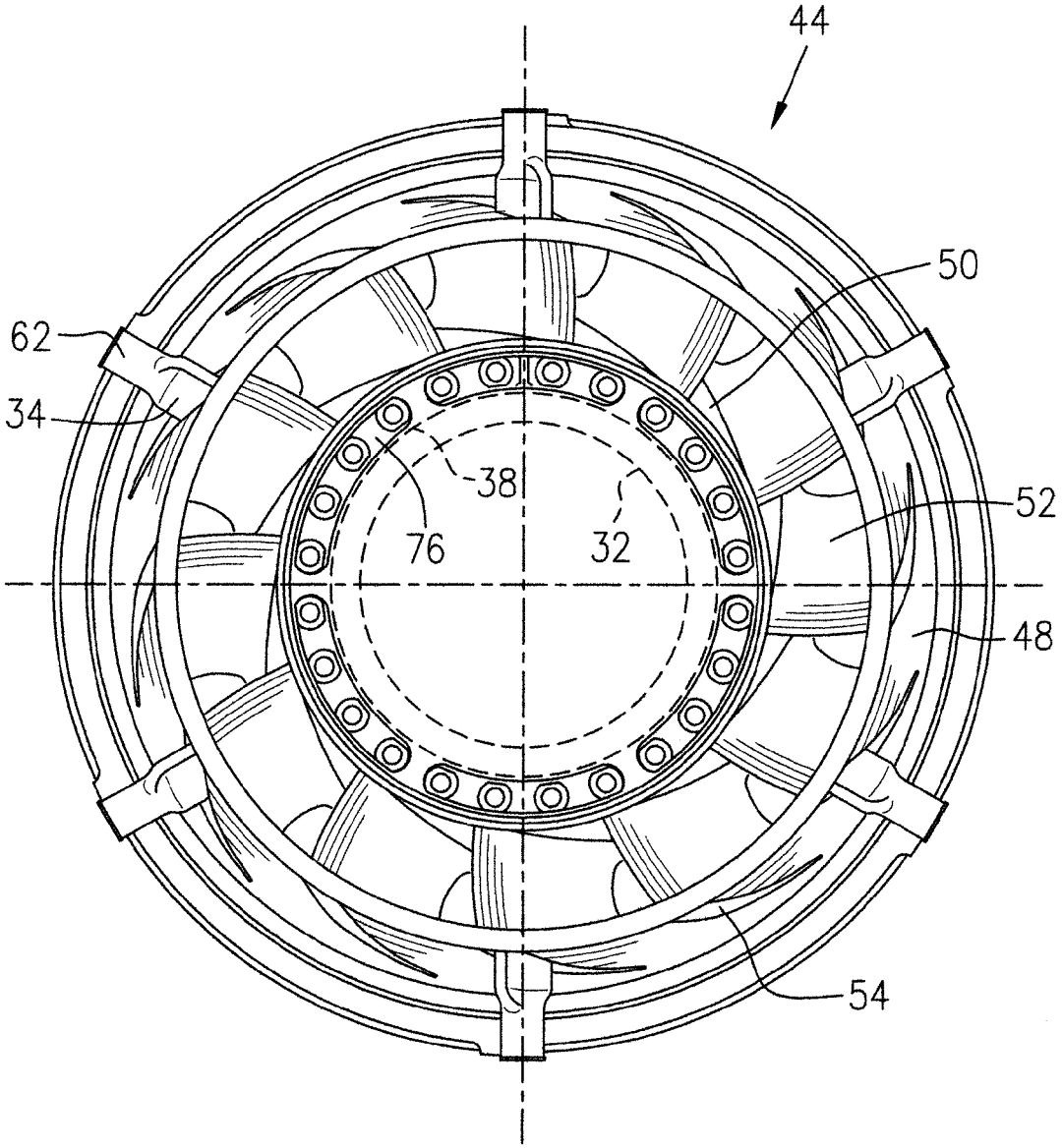
FIG. 5 is a rear elevational view of the ITV having the respective load transfer spokes radially extending therethrough, showing the curved plates of the spokes in combination substantially forming an annular and radial flange.

The circumferentially curved plate 76 of the respective load transfer spokes 34 according to one embodiment, may have a circumferential dimension large enough to provide a desired number of circumferentially spaced mounting openings 78 defined therein, such as four openings 78 for receiving the respective axially disposed bolts 80. Therefore, the circumferentially curved plates of the respective load transfer spokes 34 when mounted to the annular and radial flange 38 of the inner case 32, individually mate with a circumferential section of the annular and radial mounting flange 38 of the inner case 32 and in combination cover an area, for example more than 50 percent of an entire area, of a contact surface of the annular and radial mounting flange 38. In one embodiment as shown in FIG. 5, the circumferentially curved plates 76 of the respective load transfer spokes 34 in combination may have a total circumferential length more than 80 percent of a circumferential dimension of the annular and radial mounting flange 38 of the inner case 32 (shown in broken lines). The load transfer spokes 34 with such a circumferentially enlarged inner end configuration, provide an enhanced connection to the inner case 32 for effective load transfer functions.

Figure 2:
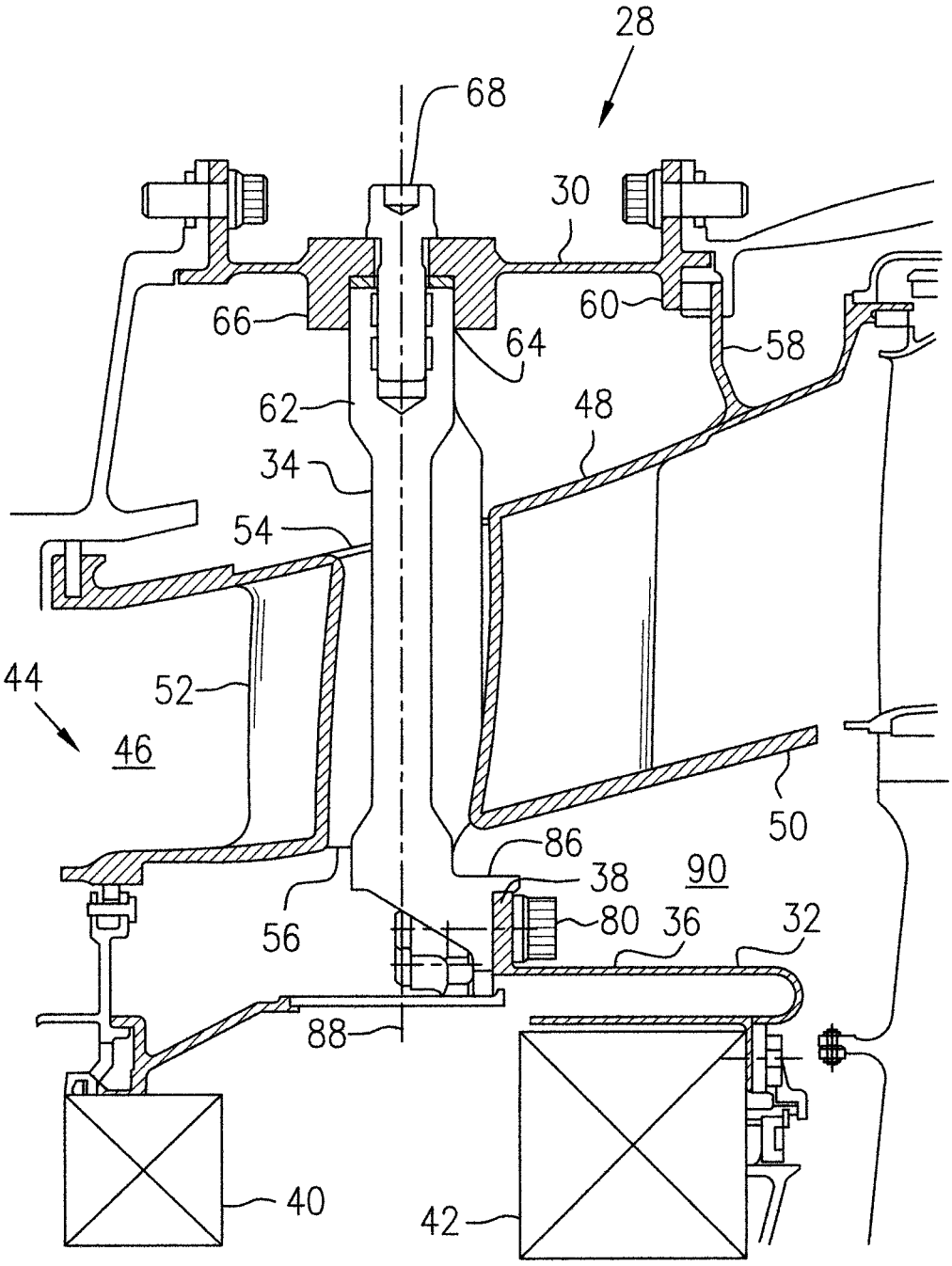
FIG. 2 is a cross-sectional view of a mid turbine frame (MTF) having an interturbine vane (ITV) assembly, according to one embodiment.
Figure 4:
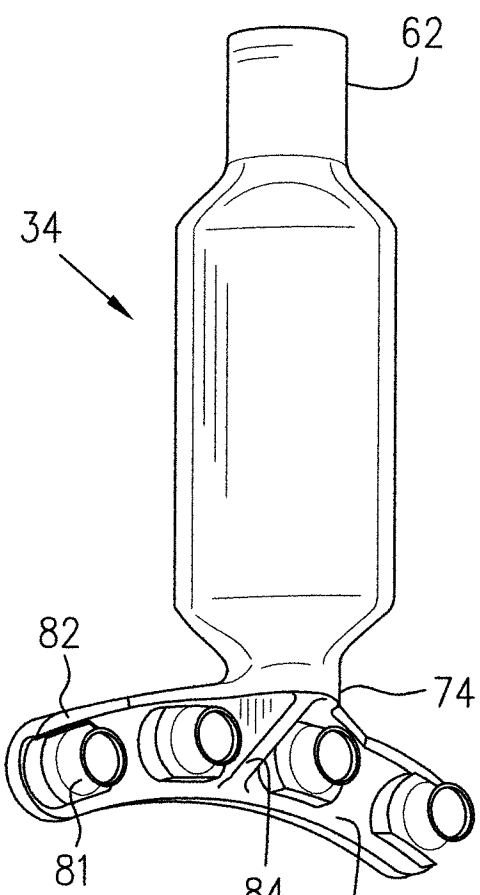
FIG. 4 is a front perspective view of the load transfer spoke of FIG. 3, showing a plurality of clinch nuts attached to the curved plate.
Figure 3:
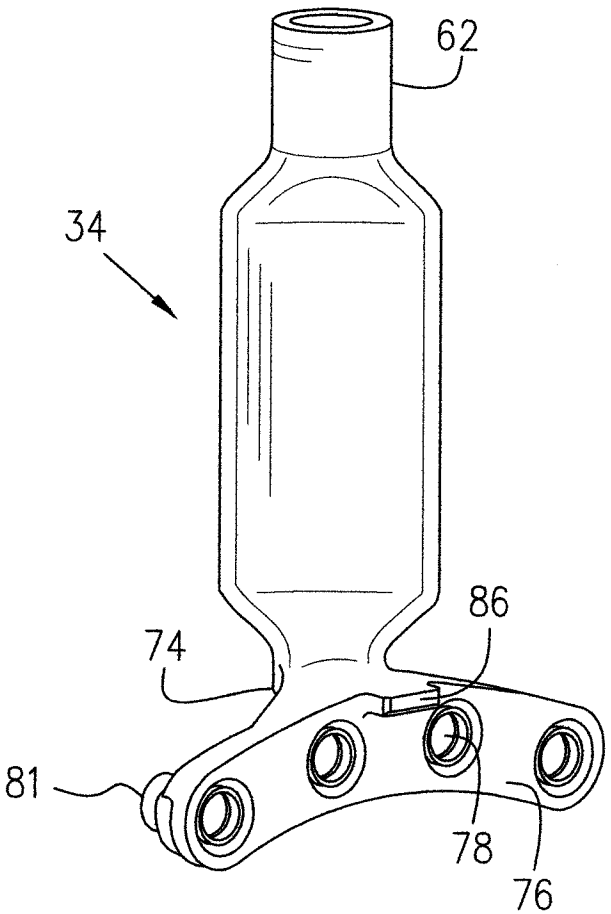
FIG. 3 is a rear perspective view of a load transfer spoke used in the MTF of FIG. 2, having an inner end with a curved plate for connection with an inner case of the MTF.

The respective load transfer spokes 34 in one embodiment may have a substantially flat middle section to best fit into, for example the airfoil-profiled hollow struts or vanes 52, in order to ensure there is enough space between the load transfer spokes 34 and the surrounding wall of the struts or vanes 52 which are directly exposed to hot gases passing through the annular duct 46, to reduce thermal affect on the load transfer spokes 34. The cylindrical section of the outer end 62 of the respective load transfer spokes 34, may have a diameter which allows the outer end 62 of the load transfer spokes 34 to extend through the hollow struts or vanes 52 and the openings 54, 56 in the ITV assembly 44. The circumferentially curved plates 76 of each load transfer spoke 34 when in the position for connection with the annular and radial mounting flange 38 of the inner case 32 according to one embodiment, may be off-set from a central axis 88 of the spoke, and may be axially and rearwardly spaced apart from the central axis 88 of the load transfer spokes 34, thereby providing convenience of access to the axially disposed mounting bolts 80 which are located in an annular space 90 located radially between the inner case 32 and the ITV assembly 44 in a location relatively close to a rear opening (not numbered) of the annular space 90. The rear opening of the annular space 90 is defined by the respective rear axial ends (not numbered) of the inner case 32 and the ITV assembly 44, as shown in FIG. 2

The described subject matter advantageously provides an MTF which occupies a limited radial space between the ITV assembly and the inner case/bearing assemblies, resulting in a simplified non-structural ITV assembly which is easier to manufacture and provides the possibility for aerodynamic efficiency. The described subject matter also advantageously allows use of a bigger bolt diameter for the mounting bolts 80 and better access for assembly of the mounting bolts.

The above description is meant to be exemplary only, and one skilled in the art will recognize that changes may be made to the embodiments described without departure from the scope of the described subject matter. For example, the ITV assembly may be configured differently from that described and illustrated and any suitable connection of the load transfer spokes to the outer case may be used. Engines of various types other than the described turbofan gas turbine engine will also be suitable for application of the described subject matter. Still other modifications which fall within the scope of the described subject matter will be apparent to those skilled in the art, in light of a review of this disclosure, and such modifications are intended to fall within the appended claims.

The invention claimed is:

1. A gas turbine engine mid turbine frame comprising an annular outer case and an annular inner case, the inner and outer cases positioned around an engine axis, a plurality of circumferentially spaced load transfer spokes extending radially between the inner and outer cases, the inner case supporting at least one main shaft bearing assembly of the engine, the inner case co-axially mounted to the outer case by the spokes; and the spokes having an inner end having a width which is circumferentially enlarged relative to a width of a remainder of the spoke, the inner end having a radially and circumferentially extending face configured to mate a corresponding face on the inner case, a plurality of threaded fasteners extending axially through said mating faces to secure a firm connection of the respective spoke to the inner case, wherein the circumferentially enlarged inner end of each of the spokes comprises a curved plate and an axial reinforcing rib integrated with the curved plate, the curved plate having a plurality of mounting openings for receiving the respective axial threaded fasteners to extend therethrough.

2. The mid turbine frame as defined in claim 1 wherein said width of the inner end and remainder of the spoke are integrally configured such that the spoke profile is substantially an inverted T-shape.

3. The mid turbine frame as defined in claim 1 wherein the inner case comprises an annular flange extending radially and outwardly from an annular wall of the inner case to provide said corresponding face, the circumferentially enlarged inner ends of the respective spokes being connected to the flange of the inner case.

4. The mid turbine frame as defined in claim 1 wherein the circumferentially enlarged inner end of each of the spokes comprises a plurality of clinch nuts attached thereto for engagement with the respective axial threaded fasteners.

5. The mid turbine frame as defined in claim 4 wherein the mounting openings receive the respective clinch nuts.

6. The mid turbine frame as defined in claim 5 wherein the curved plate comprises a ridge projecting axially from a radial surface of the curved plate to prevent the respective clinch nuts from rotating.

7. The mid turbine frame as defined in claim 6 wherein the ridge extends along at least a section of a periphery of the curved plate.

8. The mid turbine frame as defined in claim 1 wherein the circumferentially enlarged inner end of each of the spokes comprises a load bearing member for bearing a portion of radial loads in an event of blade-off.

9. The mid turbine frame as defined in claim 8 wherein the load bearing member comprises a lug integrated with and axially projecting from the circumferentially enlarged inner end to radially abut an outer periphery of the inner case.

10. A gas turbine engine having a mid turbine frame assembly, the mid turbine frame assembly comprising:

an annular outer case configured to be connected to and provide a portion of an engine casing;

an annular inner case co-axially disposed within the outer case, the inner case supporting at least one bearing of an engine main shaft;

at least three circumferentially spaced load transfer spokes extending radially between the inner and outer cases, each of the spokes being connected to the outer case by at least one bolt; and wherein an inner end of each of the spokes is integrated with a curved plate, the curved plate extending circumferentially to mate with a circumferential section of an annular and radial flange of the inner case, and a plurality of axially disposed bolts fastening the curved plate to the annular and radial flange.

11. The gas turbine engine as defined in claim 10 wherein the curved plate of each of the spokes has a circumferential dimension to provide four circumferentially spaced mounting openings defined therein for receiving the respective axially disposed bolts.

12. The gas turbine engine as defined in claim 10 wherein the curved plate of each of the spokes defines circumferentially spaced mounting openings for receiving a plurality of clinch nuts positioned therein for engagement with the respective axially disposed bolts.

13. The gas turbine engine as defined in claim 12 wherein the curved plate comprises a ridge projecting axially from a periphery of a radial surface of the curved plate to prevent the respective clinch nuts from rotating.

14. The gas turbine engine as defined in claim 10 wherein the inner end of each of the spokes comprises a lug integrally axially extending from the curved plate to radially abut an outer periphery of the annular and radial flange of the inner case.

15. A gas turbine engine having a mid turbine frame assembly, the mid turbine frame assembly comprising:

an annular outer case configured to be connected to and provide a portion of an engine casing;

an annular inner case co-axially disposed within the outer case, the inner case supporting at least one bearing of an engine main shaft;

at least three circumferentially spaced load transfer spokes extending radially between the inner and outer cases, each of the spokes being connected to the outer case by at least one bolt;

an inter-turbine vane assembly disposed co-axially and radially between the inner and outer cases, the assembly including an annular duct to direct a combustion gas flow to pass therethrough, the duct being defined between annular outer and inner duct walls radially spaced apart and interconnected by at least three radial hollow vanes, the vanes cooperating with openings in the walls to provide radial passageways through the annular duct for receiving the respective spokes to radially extend through the duct; and wherein an inner end of each of the spokes is integrated with a curved plate, the curved plate extending from the inner end oppositely in a circumferential direction to mate with a circumferential section of an annular and radial flange of the inner case, a plurality of axially disposed bolts fastening the curved plate to the annular and radial flange.

16. The gas turbine engine as defined in claim 15 wherein the curved plate of the inner end of each spoke when in a position of mating with the annular and radial flange of the inner case, is off-set from a central axis of the spoke, thereby being axially and rearwardly spaced apart from the central axis of the spoke.

* * * * *